US007258259B1

(12) United States Patent
Owens

(10) Patent No.: US 7,258,259 B1
(45) Date of Patent: Aug. 21, 2007

(54) MOLDED SEMI-UNIVERSAL HOLSTER

(75) Inventor: William R. Owens, Prairieville, LA (US)

(73) Assignee: William Rex Owens, Prairieville, LA (US)

( * ) Notice: Subject to any disclaimer, the term of this patent is extended or adjusted under 35 U.S.C. 154(b) by 193 days.

(21) Appl. No.: 10/638,812

(22) Filed: Aug. 11, 2003

Related U.S. Application Data

(60) Provisional application No. 60/402,240, filed on Aug. 9, 2002.

(51) Int. Cl.
*F41C 33/02* (2006.01)

(52) U.S. Cl. ..... 224/193; 224/192; 224/912; 224/243

(58) Field of Classification Search ..... 224/193, 224/192, 912, 3.9, 243, 232, 930; D3/222, D3/223
See application file for complete search history.

(56) References Cited

U.S. PATENT DOCUMENTS

| | | | | | |
|---|---|---|---|---|---|
| 3,630,420 | A | * | 12/1971 | Bianchi | 224/193 |
| D236,891 | S | * | 9/1975 | Welssenburger | D3/222 |
| 3,942,692 | A | * | 3/1976 | Chica | 224/243 |
| 4,062,481 | A | * | 12/1977 | Clark | 224/243 |
| 4,084,734 | A | * | 4/1978 | Bianchi et al. | 224/192 |
| 4,277,007 | A | * | 7/1981 | Bianchi et al. | 224/193 |
| 4,463,884 | A | * | 8/1984 | Parlante | 224/243 |
| 5,100,036 | A | * | 3/1992 | Rogers et al. | 224/244 |
| 5,150,825 | A | * | 9/1992 | Nichols | 224/243 |
| D331,497 | S | * | 12/1992 | Dixon | D3/222 |
| 5,167,355 | A | * | 12/1992 | Hill | 224/193 |
| 5,269,448 | A | * | 12/1993 | Shoemaker | 224/243 |
| 5,282,539 | A | * | 2/1994 | Saathoff | 211/64 |
| 5,372,288 | A | * | 12/1994 | Rogers et al. | 224/198 |
| 5,467,909 | A | * | 11/1995 | Resca et al. | 224/244 |
| 5,570,830 | A | * | 11/1996 | Nichols | 224/676 |
| 5,622,295 | A | | 4/1997 | Hellweg et al. | |
| 5,622,297 | A | | 4/1997 | Rogers et al. | |
| D392,458 | S | * | 3/1998 | Batts | D3/222 |
| 5,820,003 | A | * | 10/1998 | Nichols | 224/575 |
| 5,931,358 | A | * | 8/1999 | Rogers | 224/243 |
| 5,944,239 | A | * | 8/1999 | Rogers et al. | 224/193 |
| 6,112,962 | A | * | 9/2000 | Matthews | 224/243 |
| 6,398,089 | B1 | * | 6/2002 | Har-Shen | 224/192 |
| 2005/0127121 | A1 | * | 6/2005 | Wells | 224/193 |

OTHER PUBLICATIONS

Print-outs from Kydex Company's website; Aug. 11, 2003.

* cited by examiner

*Primary Examiner*—Nathan J. Newhouse
*Assistant Examiner*—Justin M. Larson

(57) ABSTRACT

A receptacle for firearms that comprises a primary receiving cavity for a firearm that is considered to be semi-universal and has multifunctional capabilities. This primary receptacle allows the user to adjust the receiving cavity to fit a plethora of sizes, styles, and calibers within a certain model line. This is accomplished by a series of dual adjustment springs and molded stops that function together to customize tension and squeeze within the receptacle. The compact and ergonomic design allows the receptacle to be easily interchangeable among a variety of carriage or mounting apparatuses.

14 Claims, 8 Drawing Sheets

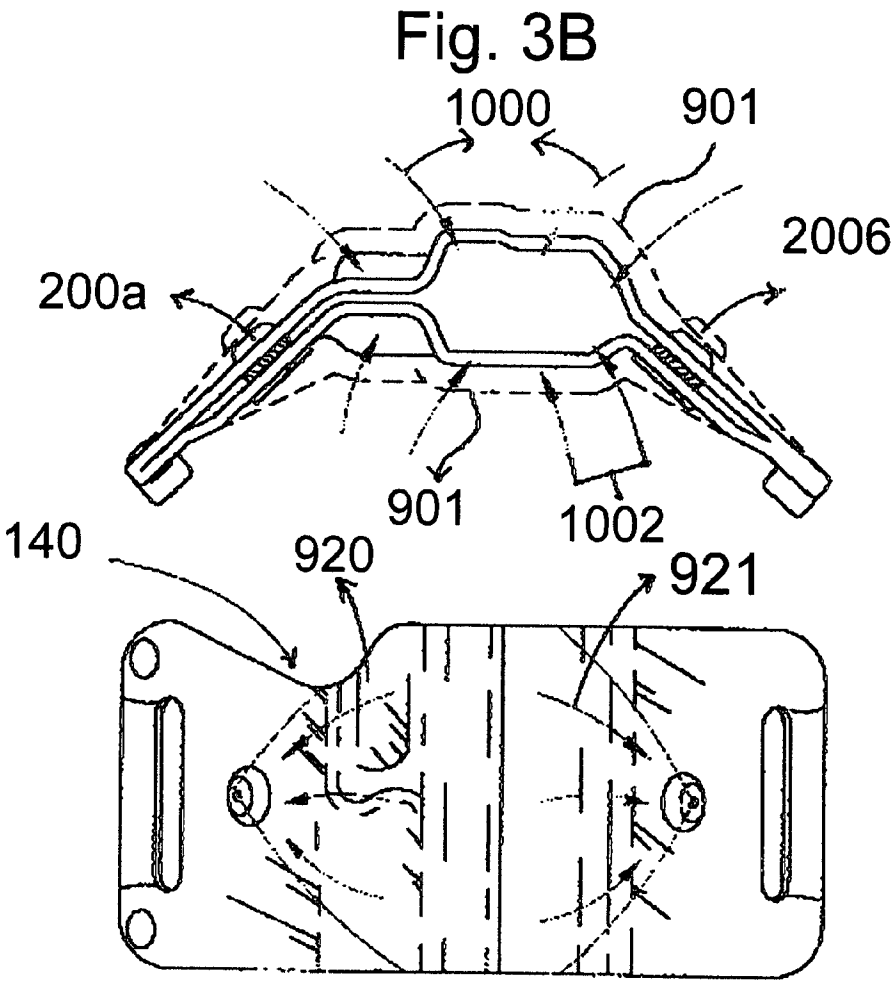
Fig. 3B
Fig. 3A
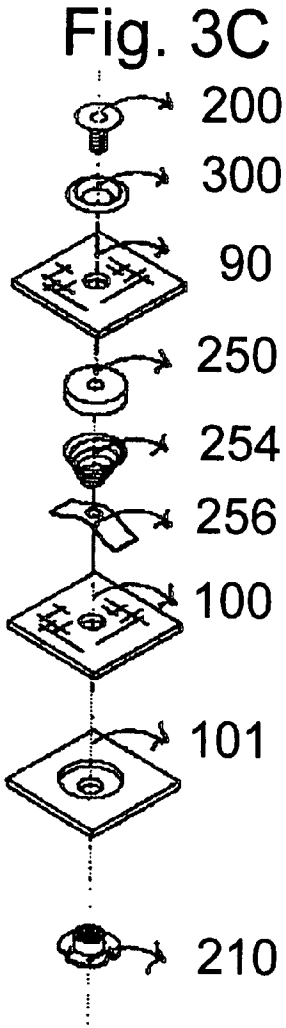
Fig. 3C

MOLDED SEMI-UNIVERSAL HOLSTER

This application is a standard patent application and claims priority to U.S. provisional application Ser. No. 60/402,240, filed Aug. 9, 2002.

FIELD OF INVENTION

This invention relates to handgun holsters and, more particularly, to holsters that have various adjustments to enable the holster to accept handguns of the same design ranging in a variety of calibers.

BACKGROUND OF THE INVENTION

Since the invention of the sidearm, holsters have been created to accommodate an efficient way of carriage. As the number and range of sidearms advanced, so has holster technology. Often owners of multiple handguns face the costly problem of supplying a holster for every firearm. This not only can be very costly, but also very confusing when fitting a holster to firearms of similar models having different calibers. This creates a need for a holster that can accommodate a variety of pistols of the same style/model, but ranging in different widths due to the caliber. Any such holster must address a variety of factors, including:

1. Functionality;
2. Semi-universal Qualities; and
3. Interchangability.

Although some holsters may be very functional, they do not posses the quality of being very versatile. The term semi-universal (or semiversal) holster will be defined as a holster having a cavity for receiving a firearm that forms a structure around this entity, that has specific molded qualities which enable a certain style/model to fit while possessing the ability to adjust to various thickness to accommodate different calibers of this style firearm. Most holsters are pistol-specific in design and function, giving little room for multiple applications. For example, a firearm concealment rig that houses a specific firearm is useless when the user chooses to place another firearm of the same model/style having a different caliber. This forces the owner to purchase an additional holster for concealment. Each specific application or function and each handgun model/design thus requires a completely different holster for the firearm. The quality of a holster being semiversal in nature is very advantageous for the owner of multiple firearms. A good example is the Glock pistol. Many law officers carry such a weapon on duty. Many also have several models of the same pistol. Glocks have similar structure/design that may vary in length and thickness depending on the caliber. A holster that could fit all Glocks and have the ability to adjust to the user's discretion solves the confusion while saving money. Although attempts have been made to produce holsters that are semiversal in nature, the resulting products have been unacceptable by many or lack dimensions that are specific enough to give a desired fit (see Hellweg, U.S. Pat. No. 5,622,295 and Rogers, U.S. Pat. No. 5,622,297). In certain instances, the receiving cavity did not adequately define the specific dimensions necessary to custom-fit a specific range of styles/models. Additionally, in most instances, the holster material itself was relatively flimsy, even stretchy, provided little protection, little security, and proved to be unable to withstand extended use.

One universal holster has been designed, as specified in my patent application Ser. No. 09/921,740, hereby incorporated by reference. This holster accommodates a wide range of different manufacturer handguns due to the internal adjustment mechanisms and internal springs. While this holster will accommodate almost any handgun, a simpler semi-universal holster is still needed.

Problems with functionality lie generally within the longevity of the material. Although supple leather and cloth are functional in holster design, adverse conditions (i.e. stresses and weather) can degrade such materials. A relatively rigid material that resists these conditions and remains durable is more desirable. When pertaining to law enforcement and military, this need for durability is even greater, not only for longevity, but also for reliability. The holster must be resilient to certain stress points and at the same time, it must fit the firearm securely. For the holster to be fully functional, it must be of a semi-rigid material that is weather resistant, tough enough to resist resultant stresses, and provide longevity while remaining reliable under such conditions.

Many holsters may be stand-alone functional, while others may be somewhat semiversal in nature, but there is another need to be met—and that is for the holster to be interchangeable. For a holster to be interchangeable, the function must remain consistent even though the holster may not necessarily be semiversal. Interchangeable can be defined as the ability to be worn in different positions on or away from the body. In the past, each body position required design changes to accommodate mounting of the holster. The present trend of holster designs has failed to produce a product that simultaneously meets all three criteria of functionality, semiversal, and interchangeable.

SUMMARY OF THE INVENTION

It is the object of this invention to bring forth a new and improved holster system that wilt provide functionality, be semiversal, and interchangeable in nature.

It is another object of this invention to provide a holster that can be adapted to fit a variety of different handguns, especially firearms that have similar frames representative of certain models/styles that range in different calibers.

It is another object of this invention to provide a holster that can be easily concealed on the body if deemed necessary by the user.

It is another object of this invention to provide a holster made from a semi-rigid to rigid material that can be adjusted to snugly fit a variety of handgun models of different calibers.

It is another object of this invention to show the compressible features and stress points that allow the holster to custom-fit to varying widths due to different calibers.

It is another object of this invention to show how varying holster adjustments will allow for preferred tension around the trigger guard to assist in weapon retention.

It is another object of the invention to show how having varying holster adjustments that allow for preferred tension around the barrel slide portion of the weapon can aid in firearm retention.

It is another object of this invention to show that the design of the holster encompasses two independent forming styles that can be used to get the desired holster.

It is another object of this invention to provide an adjustable holster that can be mounted on a variety of carrying rigs or mounts.

It is another object of this invention to provide a wearable receptacle where the receptacle sidewall separation is adjustable.

An important aspect of the present invention centers around a holster embodiment having a handgun receiving cavity with an upper end for receiving the barrel end of the handgun, a lower portion allowing the firearm to be partially or fully enclosed, and having an indentation molded and elongated along the forward barrel slide portion of the holster and trigger guard cavity forming a recess for receiving the barrel end and trigger guard portion of the firearm. The firearm is essentially sandwiched between a single fold or between double strips of semi-rigid material such as Kydex or comparable material. When formed, the folded material produces forward and rearward walls or shells (or first and second sides) forming a recess or cavity between the walls for receiving the firearm and two extended portions on either side of the firearm recess. Radiating from the outer most extremities toward the medial line of the holster cavity, a widen gap is formed separating the forward and rearward sections of the holster. The separation forms a cavity allowing the width of the holster to be adjusted. The assembly hardware holding these separated sections together includes a spring-loaded biasing means that forms tension of the innermost cavity to spring apart maintaining constant tension and spreading between the innermost walls of the holster material. The connective hardware serves another function to connect and hold the holster walls together, bringing both frontal and rearward sections together to form a complete cavity for receiving the handgun. The adjustment assembly being comprised of hardware such as Tee-nuts, set screws, finishing washers, springs, rubber washers, spring steel, or similar material are essential to the dual functions discussed previously. In the preferred embodiment, the holster walls are permanently connected to one another by either fusing the shell material together or securing the shells by hardware such as rivets, Chicago screws, binding screws, or hardware of a similar nature at the outermost extremities of the holster. For certain applications it may not be deemed necessary to permanently fix the outermost extremities, but rather to allow spacing for added fixtures such as clasps, snaps, hooks, rings, or materials of similar nature to be used to make the holster interchangeable between various carriage positions. The preferred embodiment is ergonomically designed to ride close to the body by using a tilted flange on the outermost extremities producing an angle of bend between 35-55 degrees toward the medial line of the body. In one preferred embodiment, the holster contains two slotted grooves on the outermost extremities for belt attachment. At the outermost lateral section of the grooves away from the mid-line of the holster slotted material is molded to form an offset for comfortable belt clearance and travel. By allowing the belt to travel through the double wall holster material the holster walls are securely fixed on the body. The design of carriage insures the holster is fail proof from coming apart under extreme stresses.

Another aspect of the preferred embodiment deals with grip clearance for firearm removal. Underneath the pistol grip of the firearm, when in the receiving cavity, a semicircular groove has been removed from the material to allow free clearance for secure gripping of the firearm without interference upon withdrawal. Another feature of the preferred embodiment occurs at the entrance section of the holster cavity. A slight molded tilt is placed at the forward and rearward section of the receiving cavity to allow easy alignment of the firearm barrel when being placed in the holstered position. The molded flange acts as a funneling apparatus for the pistol. In a preferred embodiment of the invention, the adjustment screws located on both sides of the firearm receiving cavity can work independently or in conjunction with one another to adjust the desired width, retention, and squeeze placed on the desired pistol. The adjustment screw located below the trigger guard housing mediates the stresses placed on the left hand side of the holster by restricting the amount of space used to house the trigger guard and lower barrel slide portion of the firearm. The adjustment screw located above the right section of the barrel slide of the firearm functions to place stress points on upper, lower, and medial locations of the barrel slide portion of the firearm. This adjustment configuration, when used separately or in conjunction with the other adjustment screw, pulls or loosens the holster walls together or apart to give the tension, restriction, retention, and fit desired by the user.

Another feature of the preferred embodiment is molded features in the holster walls. Either the front, rear of both walls of the forming of the holster cavity has features molded in the cavity wall that correspond to features of the firearm or sidearm to be stored in the holster cavity. In general, the front section of the holster has a more refined definition of the sidearm. The trigger guard becomes well defined on the outer and inner edges, having a molded indention of the trigger guard housing as well as upper and lower configurations of the pistol style desired. This serves several different functions of the holster for a pistol in respiratory position: 1) the outline of the trigger guard acts as a limiting device for depth and position of the firearm in a holstered position as well as weapon retention, grabbing the trigger guard portion of the pistol; 2) the upper indentation along the barrel slide portion, and lower indentation along the barrel slide portion of the holster, acts as barrel slide adjustments keeping the firearm in line with the holster at all times and aid in producing friction to the barrel slide when adjusted, leading to a custom fit; and 3) the elongated protrusion radiating along the upper portion or the holster acts as a barrel sight channel for protecting the sight and prevents unnecessary interference with the holster upon removing or replacing the pistol in a holstered position. Examining the rear section of the holster, the back shell forms a basic outline of the desired model allowing for complimentary indentations to support the front portion of the holster formation when placed together. Both shells contain the same angle of bends, belt loop indentations, and grooves to match to corresponding mate. The overall construction of the holster is designed for a multitude of applications having a compact structure, durable build, semiversal construction, and interchangeable characteristics.

BRIEF DESCRIPTION OF THE DRAWINGS

The present invention will be shown in some preferred embodiments to better explain and illustrate the nature of the function of the receptacle. Contained in this illustrated description are reference numerals accompanying the drawings referring to specific parts.

FIG. 3A is a frontal side view of the tension adjustment arrows of said receptacle.

FIG. 3B illustrates a horizontal bottom view of the compression adjustments of said receptacle.

FIG. 3C is an exploded view of the adjustment assembly hardware and options of said receptacle.

DESCRIPTION OF THE PREFERRED EMBODIMENTS

FIGS. 1A to 1E of the drawings illustrate the primary holster of the preferred embodiment. The primary holster allows for multiple adjustments to accommodate a wide variety of firearms, primarily pistols of like models and styles. FIGS. 2A and 2B demonstrate the optional use of the preferred embodiment to be adapted from structural molded attachments to addition of attachments to carry out similar or same functions. This allows the function and adjustment capabilities to stay consistent with various applications of the receptacle. FIGS. 4A to 4F expound the various belt attachment means applicable to the primary receptacle. The belt attachment means could include shoulder rigs, paddle rigs, flush mount rigs, belt loop assembly rigs, tactical rigs, and many other applications deemed necessary for further carriage needs. The whole concept revolves around a semi-versal receptacle that becomes interchangeable without loosing the function for the means it was intended.

Figures 1A, 1B, 1C, 1D, 1E:
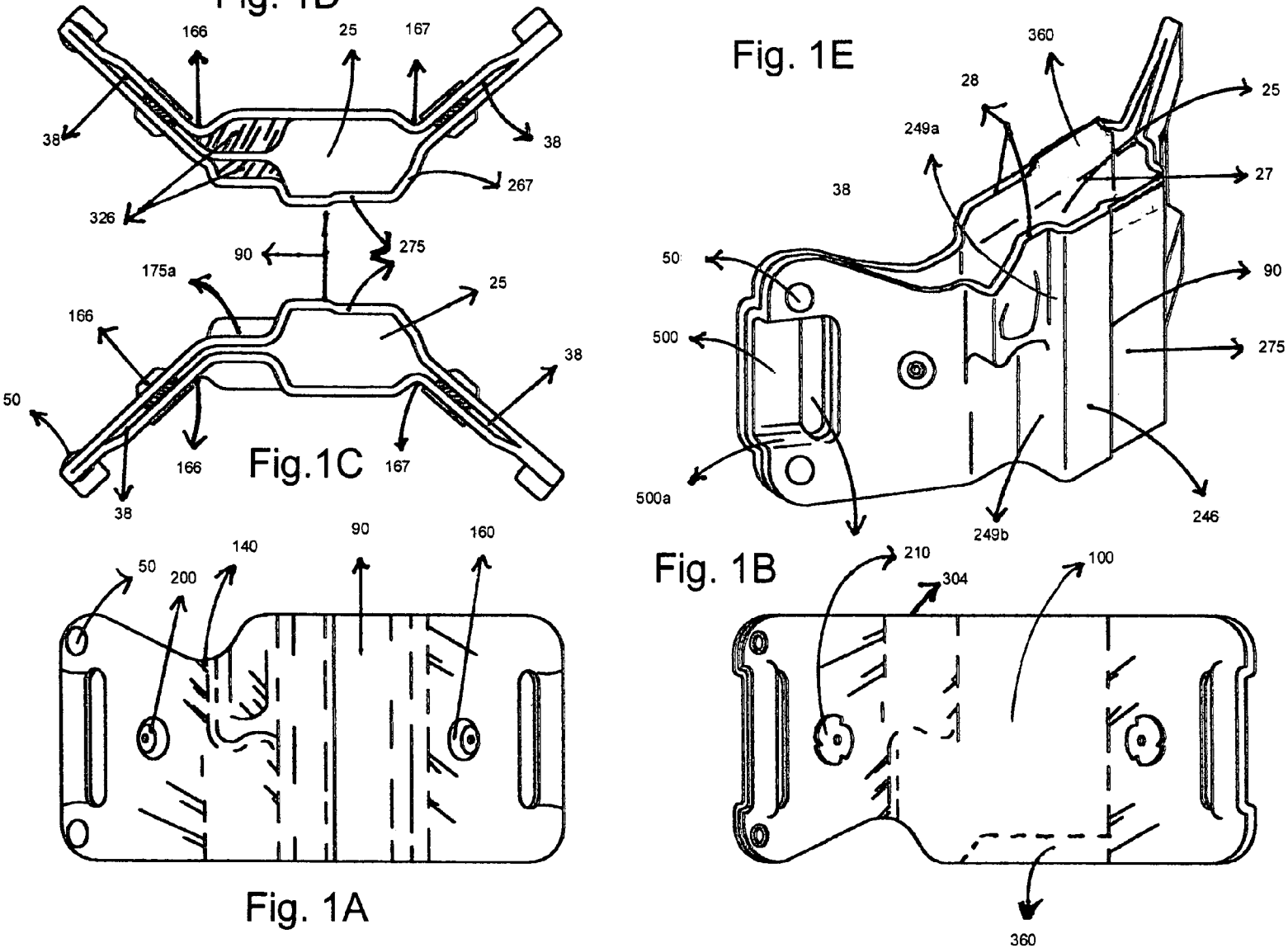
FIG. 1A is a frontal side view of the primary receptacle.
FIG. 1B is a posterior rear view of the primary receptacle.
FIG. 1C is a horizontal bottom view of the primary holster.
FIG. 1D is a horizontal top view of the primary receptacle.
FIG. 1E is an angled front view of the primary receptacle.
Figure 2B:
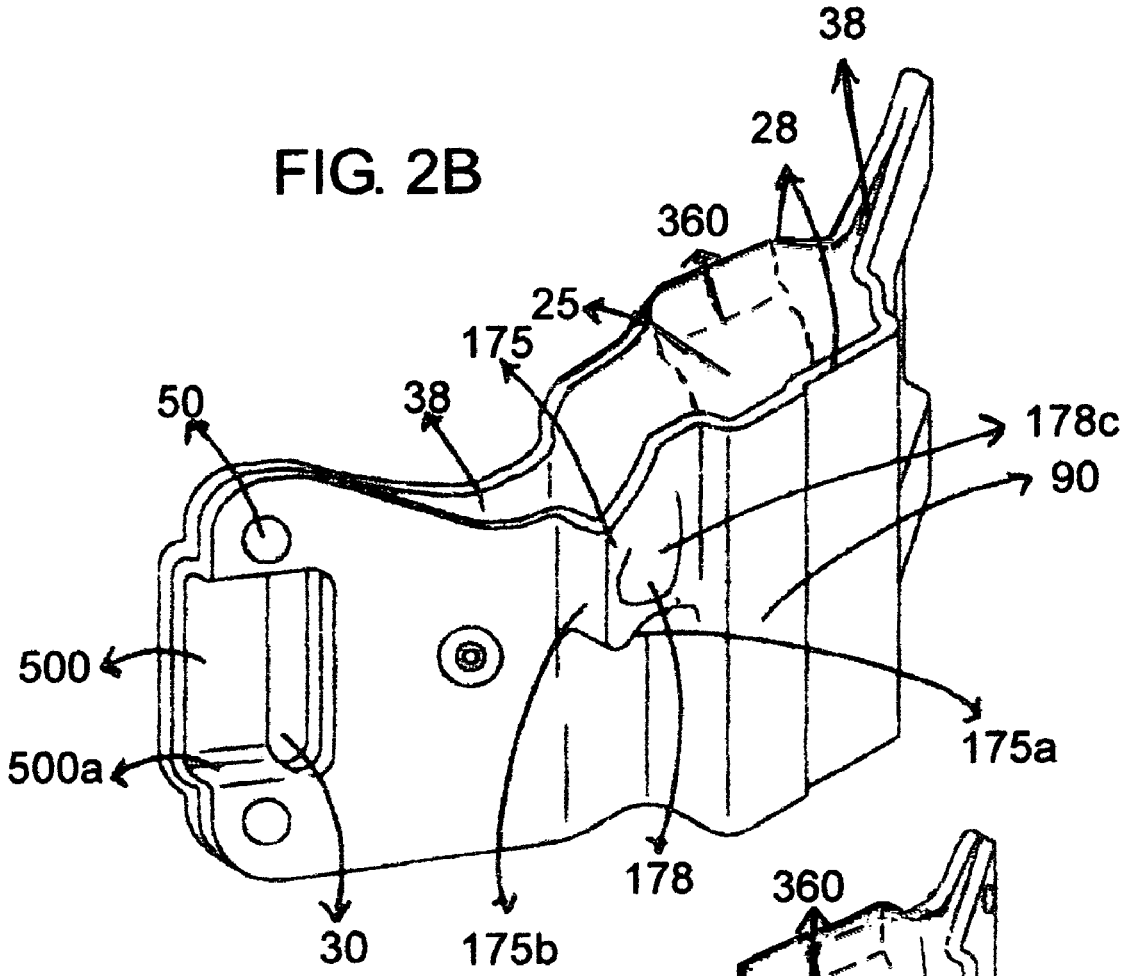
FIG. 2B is an angled front view of a preferred molded belt-loop configuration.
Figure 2A:
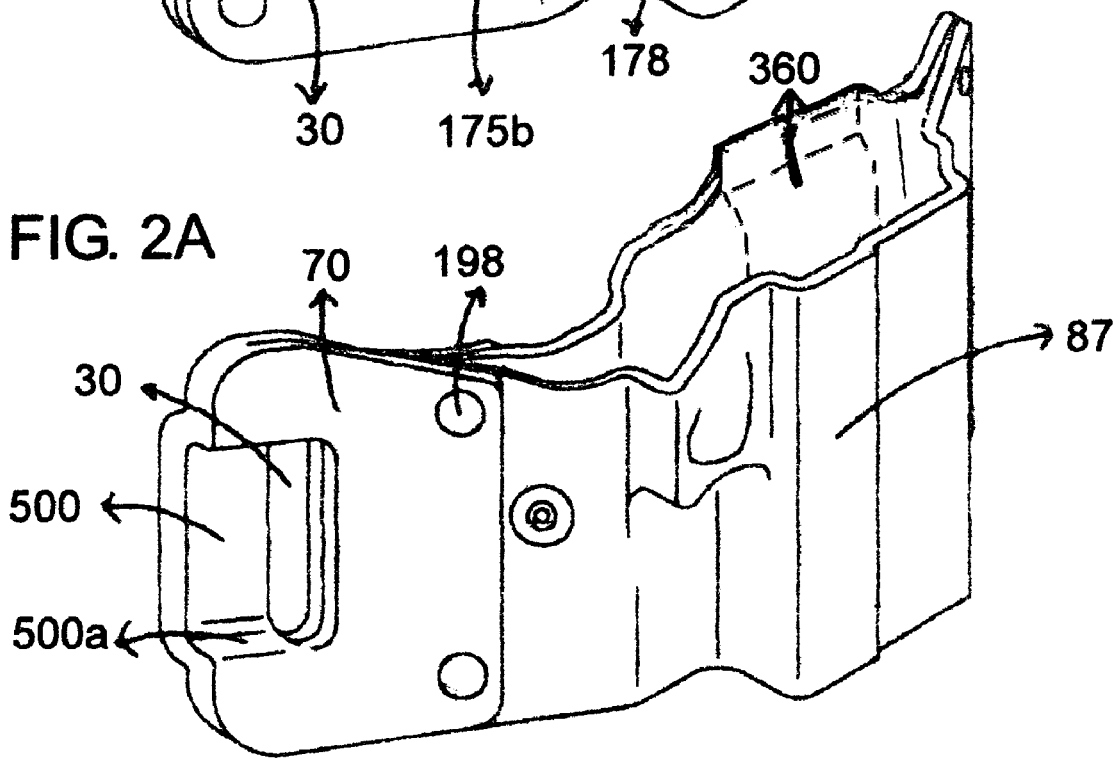
FIG. 2A is an angled front view of a belt loop attachment option of said receptacle.
Figure 4C:
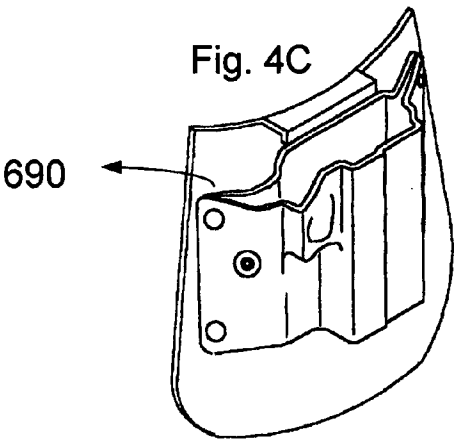
FIG. 4C is a tilted side projection view of a paddle rig option.
Figure 4B:
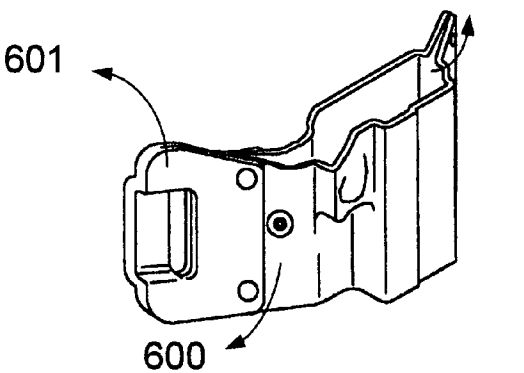
FIG. 4B is a tilted side projection view of a belt loop attachment of the primary receptacle.
Figure 4D:
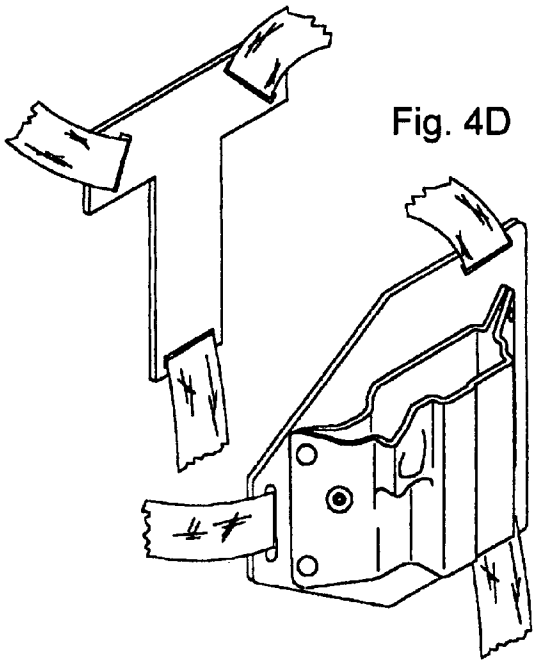
FIG. 4D is a tilted side projection view of a shoulder rig option.
Figure 4A:
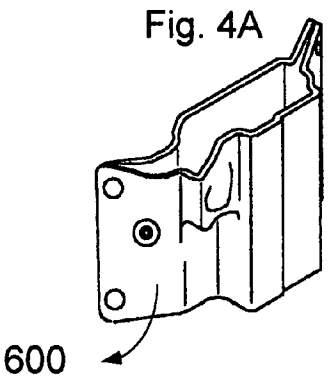
FIG. 4A is a side projection of the primary receptacle.
Figure 4E:
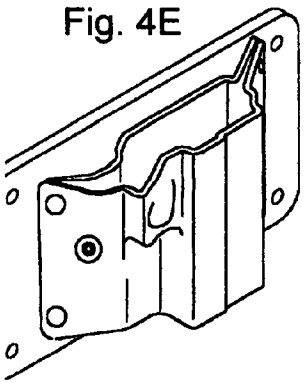
FIG. 4E is a tilted side projection view of a flush mount option.
Figure 4F:
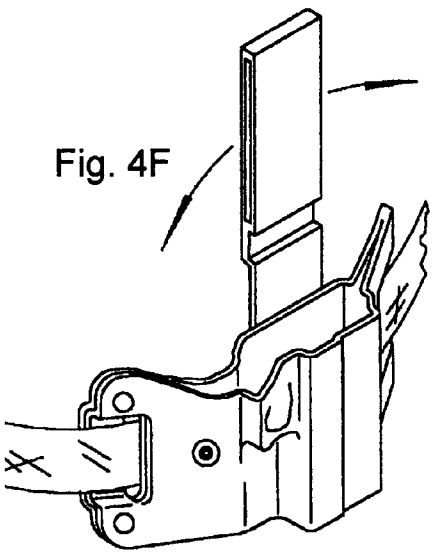
FIG. 4F is a side projection view of a thigh holster.

Illustrations in FIGS. 1A-1E show the preferred holster embodiment. The primary receiving cavity for receiving a firearm is centered between two separate sheets of molded material 28 or one single sheet folded in the center. Fixing the outer most extremities to form a closed end are rivets 50. This allows the outer extremities to be permanently fixed together. The right 700 and left edge portions 600 of the holster (distant from the cavity) are considered "ears" or "flanges." Radiating from holster cavity 25 toward the outer most ends of the receptacle resides an adjustment channel 38 between the anterior shell wall 90 and the posterior shell wall 100. The adjustment channel 38 enables the anterior and posterior shell walls to spatially be adjusted by the adjustment assembly 160. Two adjustment assemblies 160 are shown, one on each adjustment channel; two are preferred, although one may be used. As shown, the adjustment assemblies are located on the holster's ears near the middle of the holster. The adjustment assemblies can be located lengthwise from near the top of the holster (the trigger guar end) to near the bottom of the holster (the barrel end). FIG. 3C depicts an exploded view of the adjustment assembly. The configuration of the adjustment assembly sandwiches the anterior and posterior shell walls between an anterior fastener screw 200 and a posterior Tee-nut 210. The adjustment assembly includes a biasing means such as spring loaded material such as rubber spacers 250, wire spring 254, or plate springs 256 to assist in applying pressure to the internal walls of both shells forcing them apart. In some instances it may be desirable to mold a recess in the shell wall 101 to enable supporting material to collapse to a zero position when completely closed or tightened. To give a refined or finished appearance to the anterior shell wall, a finishing washer 300 may be used. By tightening and loosening the screw fastener 300 the holster cavity is able to protract and retract in respect to the medial line 27, which is shown as a imaginary dotted line centered in the middle of the holster cavity (FIG. 1E). This allows the user to adjust the gap or separation between the front and rear walls of the cavity. FIG. 3B illustrates this compression toward the medial line of the receptacle cavity. By tightening screws 200*a* and 200*b* this compressive movement increases pressure against the firearm by diminishing the space between anterior and posterior shell walls, in essence reducing the space of receptacle cavity. This adjustment enables the holster to accommodate different calibers of a desired pistol model or style. Although the preferred embodiment shows a molded structure, materials with more flexible properties could be used for similar results. For example, a leather or nylon material woven around a generic shell body and spring strips or semi-rigid material strapped within or external to the shell walls and connected by a similar adjustment assembly illustrated in FIG. 3C would allow a holster to work in a similar fashion. These materials with such a holster would be lacking the properties of longevity and durability. This is why the preferred material for the shell is Kydex, available from Kleerdex Company, 100 Gaither Drive, Mount Laurel, N.J. 08054. Kydex is an extremely durable thermoplastic acrylic/PVC alloy, and generally, kydex (1 or 2) sheets are used to form the holsters and mounts, and are fairly easily molded to accommodate desired features of the target handgun, such as molded areas corresponding to the trigger guard or barrel. Similar stiff, plastic or plastic-like materials can be used and the formation of the shell parts could be injection molded, vacuum formed, thermoformed, or even pressure molded.

FIG. 1E illustrates an angular view of the anterior position of the preferred embodiment. Belt loop 500, having molded indentations 500*a*, offset the molded material allowing free travel of a belt or strapping material to travel over the indented loop and through the loop cavity 30. An optional belt loop attachment is depicted in FIG. 2A, which shows a belt loop assembly 70 attached to the primary holster 87 having belt loop 500 with offset indentations 500*a* and a belt loop cavity 30. This attachment can be connected by item 198 which could be various fasteners such as a rivet 50 shown on FIG. 2B, Chicago screw, binding screw, snap, or similar fasteners that function to temporarily or permanently attach the belt loop assembly 70 to the primary holster 87. FIG. 2B shows the belt loop 500 and belt loop cavity 30 molded directly into the primary holster 87.

The FIG. 2B illustration demonstrates the primary receiving cavity 25 being formed from two opposite walls of material that are molded with specific features that define this cavity. One feature that limits the depth and position of the firearm in the holstered position (fully engaged in a holster) is the molded trigger guard 175. This structure, located on the anterior shell wall 90, comprises of a forward protrusion 175*a*, which defines the forward section of the trigger guard. This functions as a forward stop for a firearm in the holstered position. The lower protrusion 175*b* defines the posterior section of the trigger guard, which functions to prevent rearward movement of the firearm in the holstered position and further rotation into the adjustment channel 38.

Located above and radiating away from the trigger guard formation is the finger groove cutout 140. This section of semicircular removed material allows comfortable clearance of fingers when gripping the pistol for removal. This feature allows the wearer to have an effective combat grip on the holster. Between the protrusion 178*a* and 178*b* is an area 178*c* which corresponds to the "trigger" area between a handgun trigger guard. In this area the holster material is indented to form a trigger guard cavity recess 178*c*. The posterior shell wall mirror images the outline of the trigger guard indentation on the anterior side with the exception that other defining characteristics, such as a trigger guard cavity recess 178*c*, shown on FIG. 2B, are not required. As illustrated in FIG. 2B, the trigger guard cavity recess 178*c* is only shown on the external or outward facing side of the holster. The trigger guard recess cavity can be placed on either side, or both sides of the holster.

When the firearm is in the holstered position, the trigger guard recess 178*c* assists the wearer in gripping the trigger guard of the firearm and aids in retention and alignment of the firearm while holstered. To further understand the function of the trigger guard formation, FIG. 1D shows a top view of the receiving cavity 25 and inner wall formation of the internal walls of the trigger guard housing 326.

Other features that define and assist firearm alignment and securement are shown in FIGS. 1C and 1E. FIG. 1E depicts an elongated, raised groove called the slide channel 246, which radiates from the top anterior opening of cavity 25, down vertically to the posterior or barrel end of anterior shell wall 90. The slide channel also defines the barrel stop 249, which comprises of a molded section that originates from the channel slide and bends back toward the anterior shell wall at a 90 degree curvature. This curvature creates an offset 249*a* just above the trigger guard and defines the barrel guide 249*b* that is located at the posterior barrel portion of the holster. Features 249*a* and 249*b* act as a fixed barrel slide adjustment when the cavity walls are molded for a specific model, style, or frame of pistols.

Illustrated in FIGS. 1C to 1E, radiating transversely along the anterior shell wall 90 are the frame channel slide 246 and the barrel slide channel 275. These protrusions run from the anterior shell wall to the posterior or barrel end of the cavity. These features serve dual functions. One such function served is when the firearm is in the holstered position, inner shell wall of barrel slide channel 275 applies pressure to the barrel slide of the firearm. Pressure and tension are regulated at the wearer's discretion by adjusting screws 200*a* and 200*b*. The direction of compression or inner movement of the anterior and posterior shell walls is demonstrated on FIG. 3B by the anterior compression arrows 1000 and the posterior compression arrows 1002.

Also illustrated in FIG. 3B are the dotted compression lines 901, which demonstrate the direction of tension (exaggerated) that is applied to the anterior and posterior shell walls by tension arrows 920 and 921 (FIG. 3A). When adjustment fasteners 200*a* and 200*b* are tightened (see FIG. 1C), barrel slide channel 275 moves inward against the barrel slide portion of the firearm. The adjustment range of the fasteners allow the user to "fit" the holster to the firearm. Note that on the inward side of the holster (the body side when worn), there is no raised area for a slide channel (as best seen in FIG. 1B). Indeed, on the inward side of the preferred embodiment, the holster area corresponding to the firearm is essentially flat, except for the area 304 in front of the trigger guard, and the slight curvature in area 360. Again, the slide channel could be placed on the exterior side, interior side or both sides of the holster.

Another feature of a preferred embodiment is the sight alignment groove 267, illustrated in FIGS. 1C and 1D as an angular bent indentation along the upper portion of the barrel slide channel. This angled indentation forms an approximate 45 degree angle toward the medial line of the holster or receiving cavity and forms a clearance cavity for the front sight of the firearm. This allows the front sight to remain free and clear from the anterior shell wall upon holstering and removal of the firearm. The sight alignment groove also serves to protect the front sight of the firearm when the holster shell is more elongated than shown, to encompass the entire length of the barrel. See FIG. 6. Additional features, such as flare lip 360 illustrated in FIGS. 2A and 2B, form a funnel like structure that extends outward away from the medial line of cavity 25. This slight flared feature of the posterior shell wall 100 eases firearm entrance into the holster cavity. The feature prevents the barrel end of the firearm from hanging on the anterior and posterior shell walls when the holster adjustment fasteners 200*a* and 200*b* are tightened to give a very firm fit around the firearm.

The preferred embodiment shows a semicircular design to the overall appearance of the holster. Two structural bends are formed into the holster shell to allow a comfortable fit against the body. Illustrated in FIGS. 1C and 1D are the ergonomic angular bends 166 and 167. These bends are formed between a 35 and 55 degree angle to allow the holster to hug the hip of the wearer and aid in close body carriage. This angular bend toward the medial line of the wearer allows ease of belt loop material to glide through and over the belt loop when worn. This ergonomic design provides for a close, comfortable fit without interference of the firearm pinching or putting pressure on the wearer when sitting, standing, squatting, or other active movements of the body.

Shown in FIG. 4 are several options for wearing the primary holster 4A for different carriage positions. The holster may be positioned on various mounts or carriage rigs. The ability to interchange mounts with the same holster allows the wearer to carry or wear the primary receptacle in a variety of modes, such as: a concealment rig 4B (by attaching extending ears 601 to the ear portions 700 and 600); paddle rig 4C; shoulder rid 4D; flush mount rig 4E (which can be attached to a surface other than a user's body); and/or tactical thigh rig 4F (the top member is designed to be interlaced with a belt and the top member pivots with respect to the holster. The holster straps are designed to wrap around the leg. The pivot action allows the holster to pivot with the leg in normal articulation). As shown, the same holster is attachable to a variety of mounts. Attachment to the mount can be by screws or other attachment means through the ears of the holster into the mount material, or through a screw or other attachment means through the back cavity surface, as detailed in FIG. 5. Another application (not shown) includes a back or thigh mount for an assault rifle or shotgun.

Figures 5A, 5B, 5C:
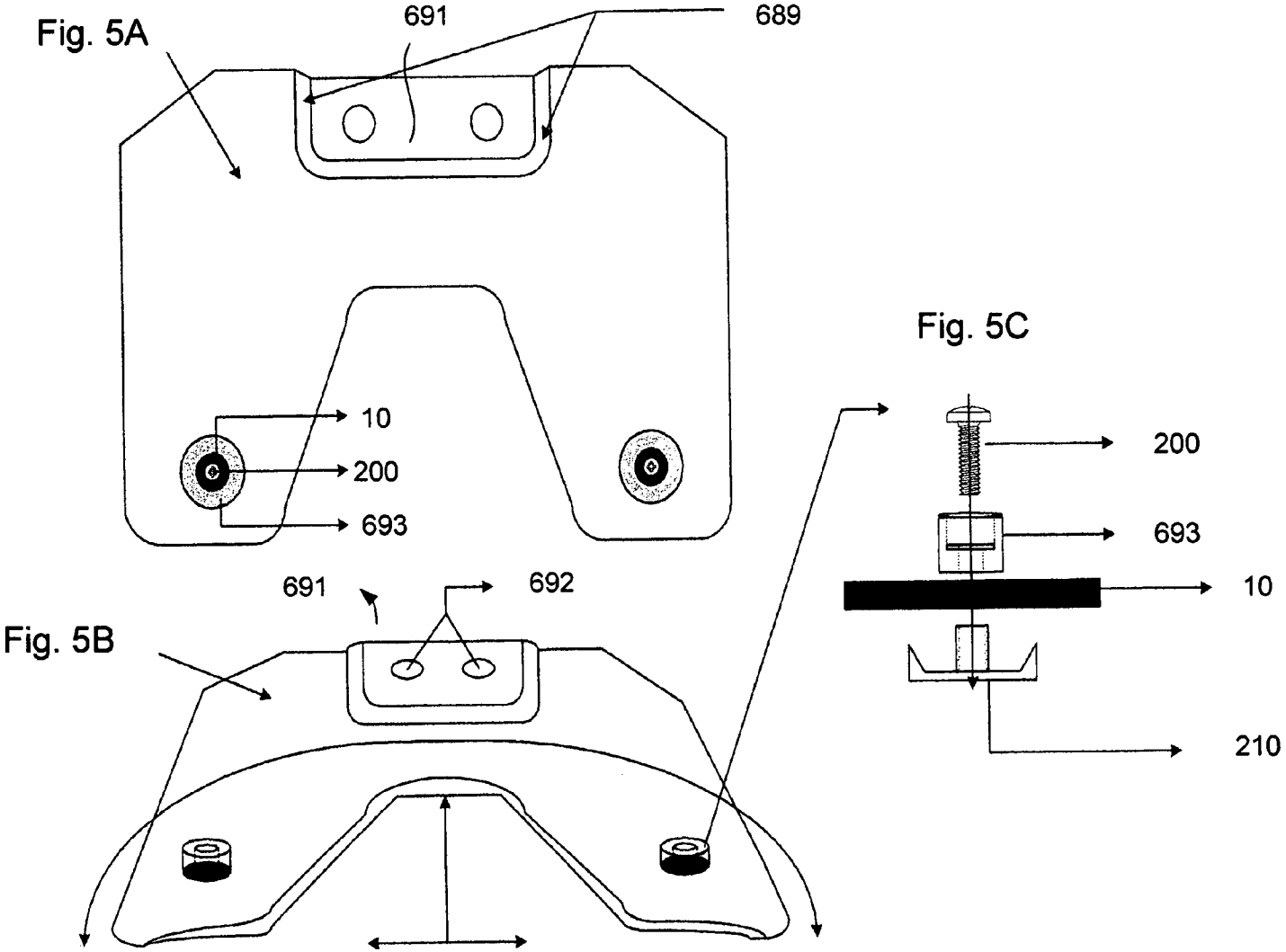
FIG. 5A is a projection view of the back of a paddle rig.
FIG. 5B is a projection side view of a paddle rig.
FIG. 5C is an exploded view of a bumper.

Shown in FIG. 5A (back view) and 5B (side view) is one embodiment of a mount associated with a paddle rig. The paddle rig (named because the mount can be "paddle shaped") is a mount to which the holster attaches creating a gap between the holster and the mount. The mount is designed to be worn next to the body, with clothing interspersed between the mount and the holster. As shown in FIG. 5A, the holster attaches to the mount at a mounting location 691, a molded raised platform or standoff (the raised area faces the holster)(instead of a molded raised platform, a thickening of the material in this area or additional material could be used). The cavity of the holster should have a similar raised area that aligns with that on the mount. Screws or other attaching devices connect the holster to the mount through openings 692 in the raised platform. When a holster is connected to the mount, a slot 690 is formed between the mount and holster, best seen in FIG. 4C. When worn, clothing is threaded into this slot. To assist in pinching the clothing for a secure fit, tow bumpers 693 are positioned on the mount facing the holster. The holster may have a similar mount positioned on the side of the holster facing the mount. This series of bumpers pinches clothing located in the slot 690 between the mount and the holster. FIG. 5C details one of the bumpers.

Figure 6:
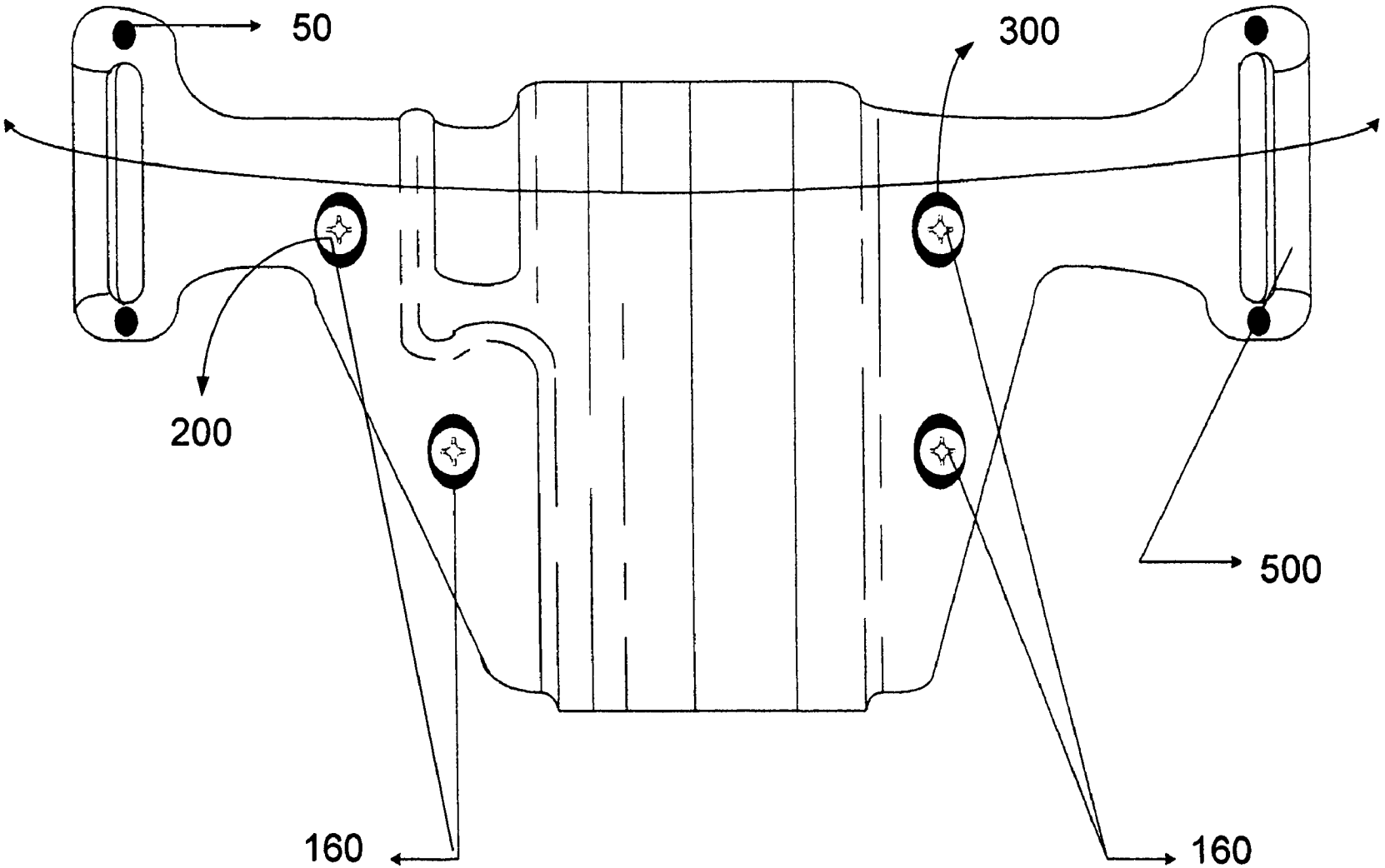
FIG. 6 is front view of an extended holster.

When the weapon to be stored in the holster is a long barreled weapon for which a longer holster is desired, additional adjustment assemblies 160 may be provided. For instance, as shown in FIG. 6, four adjustment assemblies 160 are utilized. The use of additional adjustment assemblies allows the user to tailor the pinching action of the holster along the full length of the holster.

Again, through use of the adjustment assemblies, the user can tailor the fit and "feel" of the holster to allow for a tight fit or loose fit between the holster and the stored weapon.

Figure 7:
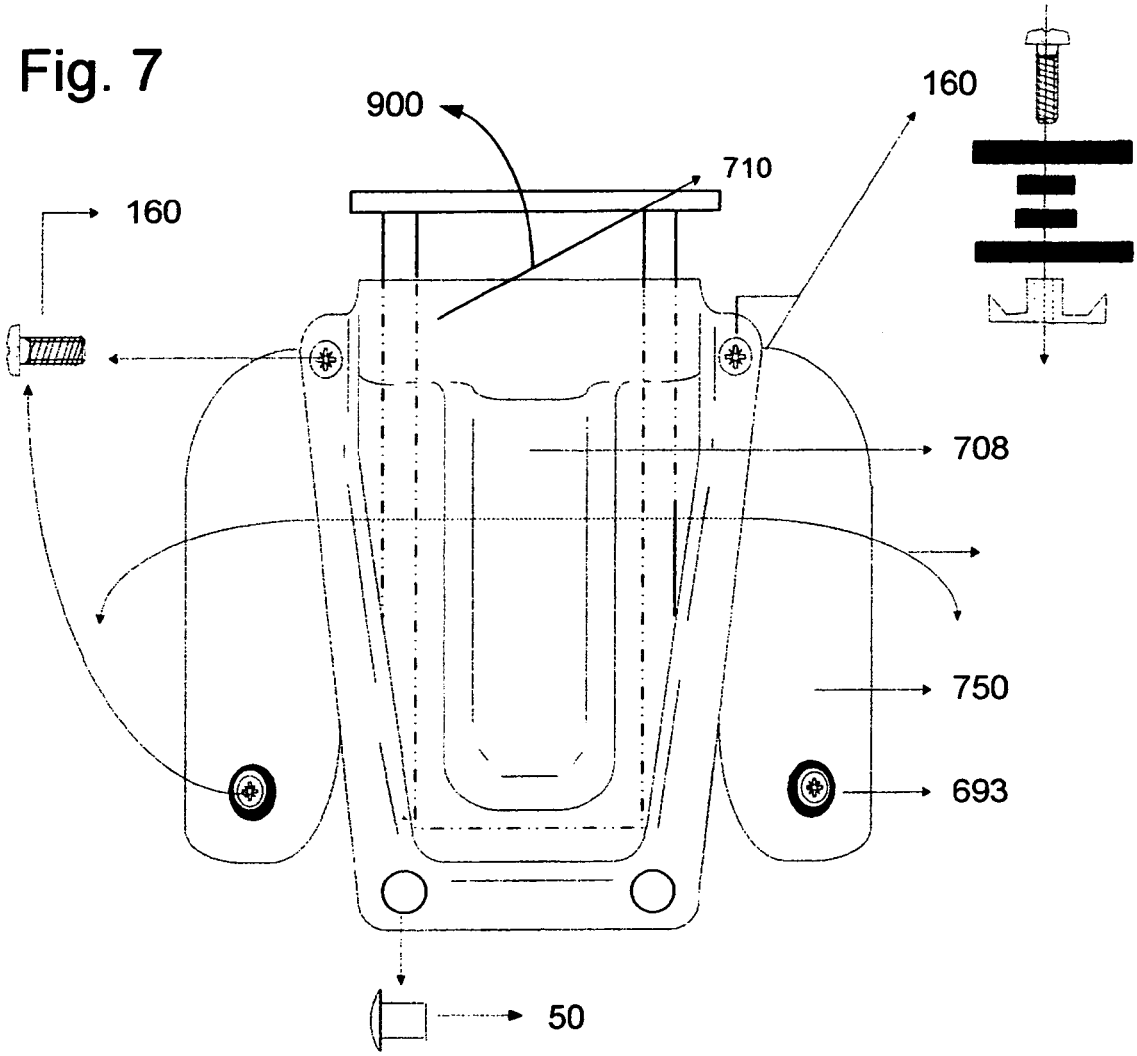
FIG. 7 is a front view of a cartridge receptacle.

Other applications are not shown, such as duty rigs for law enforcement, similar rigs for military, and even special rigs for diving. The interchangeable properties allow this system to advance into any situation and carriage system deemed useful. The adjustable wearable receptacle device shown is broader than that of a wearable holster. For instance, shown in FIG. 7 is a wearable receptacle designed for a bullet cartridge. The cartridge receptacle is attached to a wearable paddle rig 750, where the paddle rig 750 is constructed similarly to that of the paddle rig for a holster. As shown, the cartridge receptacle is constructed of two sheets of kydex which are joined together (here, with rivets 50) creating a receptacle 710 or interior space between the sheets. The top kydex sheet is molded to substantially conform to the shape of the cartridge to be stored so that the receptacle conforms to the stored device, here a bullet cartridge 900. The particular receptacle shown has a closed bottom 704, although the bottom could be open. Additionally, the top sheet has a recessed area 708. The recessed area 708 is molded into the kydex of the top sheet, and provides additional gripping on the stored cartridge. The particular receptacle has two adjustment assemblies 160 allowing the user to tailor the fit of the receptacle to the stored device. To assist in easy placement of the cartridge into the receptacle, the receptacle may have a slight flair at the top or entrance 711 of the receptacle.

Figure 8:
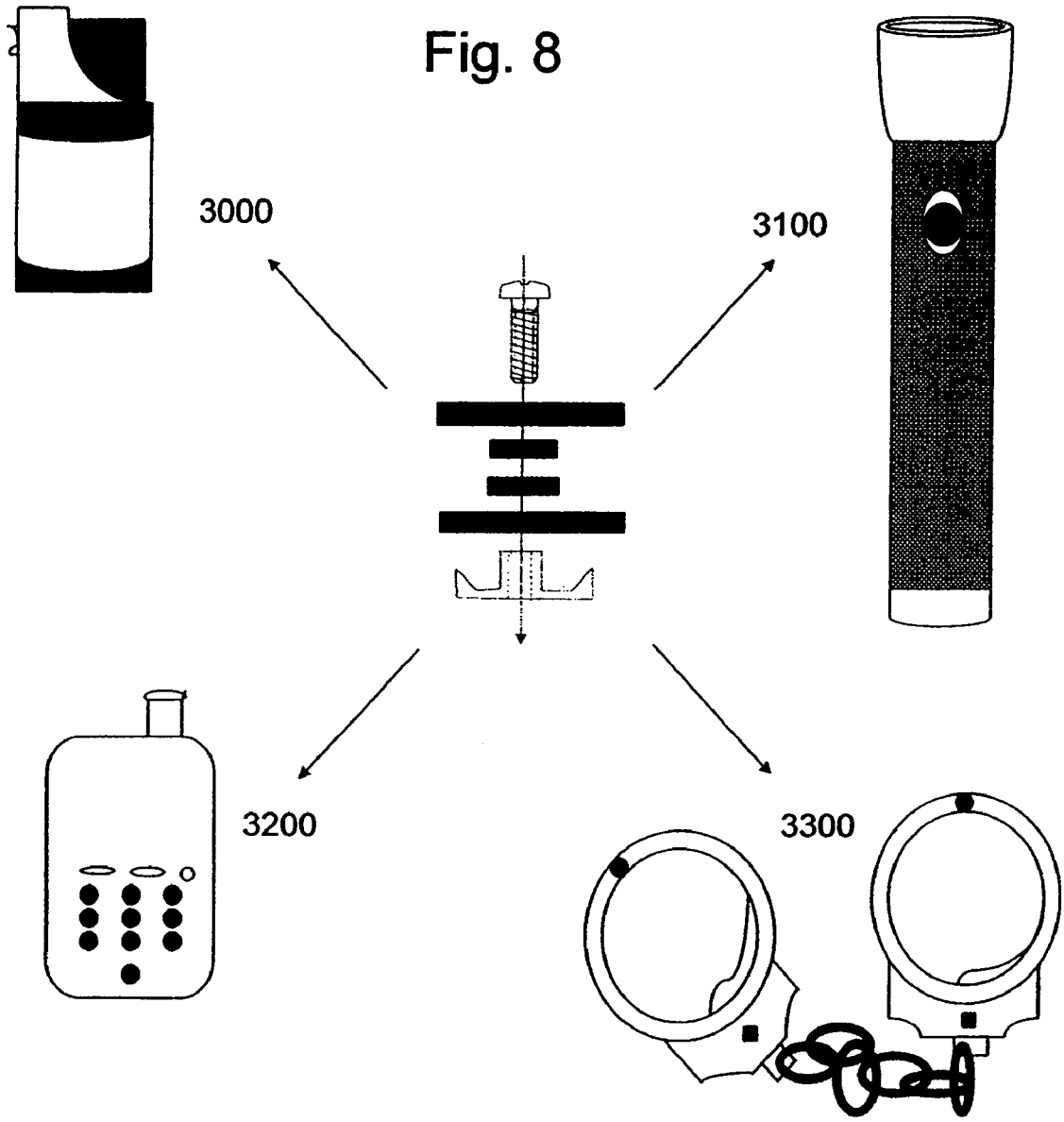
FIG. 8 illustrates a variety of devices for which receptacles could be designed.

Adjustable wearable receptacles can be designed for a wide variety of accessories, such as shown in FIG. 8, including defense spray 3000, flashlight 3100, cell phone 3200 and handcuffs 3300. For certain devices, a single adjustment assembly may be sufficient. For instance, a flashlight has a uniform cross section along the barrel (a circular cross section). Because of this uniformity, a single adjustment assembly may be sufficient for a receptacle designed to store a flashlight.

I claim:

1. A firearm storage receptacle comprising:

a single sheet of semi-rigid material folded upon itself to form a first wall and a second wall, wherein a fold in said sheet forms a first side of said firearm storage receptacle and two ends of said sheet opposite said fold are fixed together with a permanent fastener to form a second side of said firearm storage receptacle;

a holster cavity formed between said first and second walls, wherein one of said first and second walls include molded features corresponding to a particular firearm frame design;

a pair of adjustment channels also formed between said first and second walls, wherein a first adjustment channel is formed on one side of said holster cavity and a second adjustment channel is formed on a side opposite said one side of said holster cavity, wherein each of said holster cavity and said first and second adjustment channels defines a gap between said first and second walls, the gap defined by each of said first and second adjustment channels being smaller than that defined by said holster cavity;

at least two adjustment assemblies connecting said first and said second walls, wherein a first adjustment assembly is positioned through said first adjustment channel and a second adjustment assembly is positioned through said second adjustment channel so that each of said adjustment assemblies are located on opposite sides of said holster cavity and between said first and second sides of said firearm storage receptacle, wherein each of said adjustment assemblies is selectively adjustable to allow a user to adjust the size of said gap between said first and second walls;

and means for attaching said firearm storage receptacle to a user's belt.

2. The firearm storage receptacle of claim 1 wherein said holster cavity is adapted to receive a handgun.

3. The firearm storage receptacle of claim 1 wherein said belt attachment means includes a paddle rig mount attached to said single sheet of semi-rigid material.

4. The firearm storage receptacle of claim 1 wherein said belt attachment means includes first and second belt slots, said first belt slot being formed through said first and second walls adjacent said first side of said firearm storage receptacle, and said second belt slot being formed through said first and second walls adjacent said second side of said firearm storage receptacle.

5. The firearm storage receptacle of claim 1 wherein said semi-rigid material is a plastic material.

6. The firearm storage receptacle of claim 1 wherein said adjustment assemblies include a biasing means.

7. The firearm storage receptacle of claim 1 wherein said biasing means includes a spring loaded device positioned between said first and second walls.

8. A firearm storage receptacle comprising:

two separate sheets of semi-rigid material joined together to form a first wall and a second wall, wherein said sheets are fixed together at outermost ends with permanent fasteners to form first and second sides of said firearm storage receptacle;

a holster cavity formed between said first and second walls, wherein one of said first and second walls include molded features corresponding to a particular firearm frame design;

a pair of adjustment channels also formed between said first and second walls, wherein a first adjustment channel is formed on one side of said holster cavity and a second adjustment channel is formed on a side opposite said one side of said holster cavity, wherein each of said holster cavity and said first and second adjustment channels defines a gap between said first and second walls, the gap defined by each of said first and second adjustment channels being smaller than that defined by said holster cavity;

at least two adjustment assemblies connecting said first and said second walls, wherein a first adjustment assembly is positioned through said first adjustment channel and a second adjustment assembly is positioned through said second adjustment channel so that each of said adjustment assemblies are located on opposite sides of said holster cavity and between said first and second sides of said firearm storage receptacle, wherein each of said adjustment assemblies is selectively adjustable to allow a user to adjust the size of said gap between said first and second walls;

and means for attaching said firearm storage receptacle to a user's belt.

9. The firearm storage receptacle of claim 8 wherein said holster cavity is adapted to receive a handgun.

10. The firearm storage receptacle of claim 8 wherein said belt attachment means includes a paddle rig mount attached to said single sheet of semi-rigid material.

11. The firearm storage receptacle of claim 8 wherein said belt attachment means includes first and second belt slots, said first belt slot being formed through said first and second walls adjacent said first side of said firearm storage receptacle, and said second belt slot being formed through said first and second walls adjacent said second side of said firearm storage receptacle.

12. The firearm storage receptacle of claim 8 wherein said semi-rigid material is a plastic material.

13. The firearm storage receptacle of claim 8 wherein said adjustment assemblies include a biasing means.

14. The firearm storage receptacle of claim 8 wherein said biasing means includes a spring loaded device positioned between said first and second walls.

* * * * *